US011470970B1

(12) United States Patent
Ai

(10) Patent No.: US 11,470,970 B1
(45) Date of Patent: Oct. 18, 2022

(54) CONNECTING MECHANISM OF DETACHABLE CHAIR FOOT AND ASSEMBLING METHOD ASSOCIATED THEREWITH, AND CHAIR FOOT ASSEMBLY

(71) Applicant: Anji Kadi Furniture Technology Co., Ltd., Huzhou (CN)

(72) Inventor: Lu Ai, Huzhou (CN)

(73) Assignee: ANJI KADI FURNITURE TECHNOLOGY CO., LTD., Huzhou (CN)

( * ) Notice: Subject to any disclaimer, the term of this patent is extended or adjusted under 35 U.S.C. 154(b) by 0 days.

(21) Appl. No.: 17/401,491

(22) Filed: Aug. 13, 2021

(51) Int. Cl.
*A47C 7/00* (2006.01)

(52) U.S. Cl.
CPC ..... *A47C 7/004* (2013.01)

(58) Field of Classification Search
CPC ..... A47C 7/004; A47B 91/00; A47B 3/0803
See application file for complete search history.

(56) References Cited

U.S. PATENT DOCUMENTS

| | | | | |
|---|---|---|---|---|
| 7,314,252 | B2 * | 1/2008 | Ohliv | A47C 7/004 248/188.7 |
| 11,419,420 | B1 * | 8/2022 | Wu | F16B 12/42 |
| 2012/0080572 | A1 * | 4/2012 | Lin | A47C 7/004 248/188.7 |
| 2022/0218110 | A1 * | 7/2022 | Wu | A47C 7/006 |

* cited by examiner

*Primary Examiner* — Anita M King
(74) *Attorney, Agent, or Firm* — WPAT, PC

(57) ABSTRACT

A connecting mechanism of a detachable chair foot, an assembling method thereof and a chair foot assembly are provided. The connecting mechanism is connected between the central chassis and a detachable chair foot, and includes a one-foot connecting arm connected to the central chassis and extends radially outward, a connecting groove including a transversal groove opening, and a longitudinal groove opening and operatively engaged with the one-foot connecting arm, two inner-convex locking portions respectively arranged on two opposite side groove walls of the connecting groove, two longitudinal locking groove bodies respectively arranged on the one-foot connecting arm; a concave-convex matching structure arranged on the one-foot connecting arm and in the connecting groove of the detachable chair foot. The chair foot assembly with the connecting mechanism not only can save transportation space and improve transportation efficiency, but also reduce the amount of assembly work.

19 Claims, 6 Drawing Sheets

CONNECTING MECHANISM OF DETACHABLE CHAIR FOOT AND ASSEMBLING METHOD ASSOCIATED THEREWITH, AND CHAIR FOOT ASSEMBLY

TECHNICAL FIELD

The invention relates to the field of chair accessories technology, and more particularly to a connecting mechanism of a detachable chair foot and an assembling method associated therewith, and a chair foot assembly.

DESCRIPTION OF RELATED ART

A swivel chair foot assembly, also known as a five-star foot, is commonly used as an accessory for swivel chairs and office chairs, and used to install a lifting cylinder and support the swivel chair. The existing swivel chair foot assembly usually has a one-piece structure with radial foot arms. When one of the foot arms is damaged, the entire five-star foot needs to be replaced, resulting in unnecessary waste. On the other hand, the integrally formed structure of the swivel chair foot assembly occupies an excessively large space, especially when it is stored or packed for transportation, it wastes a lot of space, and its transportation cost is high, which increases the expenditure of an enterprise. If a folding/foldable structure is adopted, folding a foot assembly during storage or transportation will complicate the structure of the swivel chair foot assembly and reduce its stability and service life. For example, a Chinese invention patent publication No. CN105124963B entitled "foldable five-star foot" adopts hinge mechanisms to connect a central body with foot arms and uses limit mechanisms to achieve fixation and folding for storage. However, the foldable five-star foot has several drawbacks such as complex structure, weak strength of connection structure and easy damage.

SUMMARY

An objective of the invention is to address the above drawbacks, and provide a connecting mechanism of a detachable chair foot, a central chassis of a chair foot assembly, and a chair foot assembly. The chair foot assembly with the connecting mechanism of a detachable chair foot can save a lot of transportation space and improve the transportation efficiency. At the same time, such a chair foot assembly can also be provided in a form with a combination of a detachable chair foot and an one-piece structure chair foot, so that a certain amount of transportation space can be saved, and the amount of assembly work can be reduced at the same time.

In order to achieve the above objective, the invention adopts the following technical solutions:

A connecting mechanism of a detachable chair foot connected between a central chassis and a detachable chair foot, may include: a one-foot connecting arm, connected to the central chassis and extending radially outward; a connecting groove, disposed on a lower side of an inner end of the detachable chair foot, wherein the connecting groove is provided with a transversal groove opening at an end portion of the inner end of the detachable chair foot and a longitudinal groove opening on the lower side of the inner end of the detachable chair foot, and the one-foot connecting arm is operatively engaged with the connecting groove; two inner-convex locking portions, respectively disposed on two opposite side groove walls of the connecting groove; two longitudinal locking groove bodies, disposed on the one-foot connecting arm, wherein the two inner-convex locking portions operatively enter into the two longitudinal locking groove bodies respectively from upper groove openings of the two longitudinal locking groove bodies and are snapped into the two longitudinal locking groove bodies; and a concave-convex matching structure, configured for fixing the one-foot connecting arm into the connecting groove.

Compared with the prior arts, the advantages of the chair foot assembly of the invention may include:

The one-foot connecting arm of the connecting mechanism of a detachable chair foot is detachably connected to the connecting groove through a detachable connection of the two inner-convex locking portions, the two longitudinal locking groove bodies, and the concave-convex matching structure. The operation of the detachable connection is simple and the detachable connection is stable. The disassembly and assembly structure of the connecting mechanism is simple, and the disassembly operation and assembly operation are convenient and quick.

There are few connecting parts, so that the disassembly and assembly are quick; the stability of the chair foot assembly can be ensured in different use states of the user or during the lifting process.

The whole chair foot assembly can adopt a combination form of a part of one-piece structure chair foot and a part of the detachable chair foot, which can simplify production and processing procedures and improve production and processing efficiency. At the same time, it can also meet size requirements of the box to the greatest extent and reduce the amount of assembly work of subsequent purchasers. The design of the chair foot assembly is more humane.

The assembling method of a chair foot assembly using a connecting mechanism of a detachable chair foot of the invention to assemble the detachable chair foot to the one-foot connecting arm is simple to operate, which does not need professional tools, and the structure of the connecting mechanism is stable.

Figure 1:
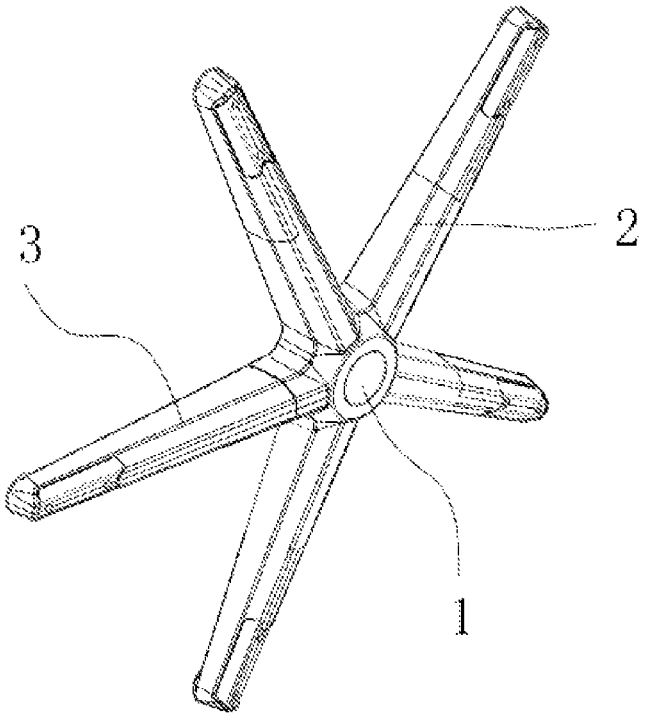
FIG. 1 is a perspective schematic structural view of a chair foot assembly according to an embodiment of the invention.

In the drawings: 1, central chassis; 2, one-piece structure chair foot; 3, detachable chair foot; 30, connecting groove; 301, transversal groove opening; 303, longitudinal groove opening; 31, longitudinal protrusion; 32, transversal groove; 321, arc locking convex surface; 33, arc-shaped concave surface; 34, second inclined matching surface; 35, flat reinforcing rib; 36, locking groove; 37, inner-convex locking portion; 371, first matching inclined surface; 372, locking arc convex surface; 373, second matching inclined surface; 38, transversal reinforcing rib; 39, longitudinal communicating groove; 5, one-foot connecting arm; 50, longitudinal groove; 51, first inclined matching surface; 511, arc locking concave surface; 52, convex; 521, lower surface; 522, connecting surface; 53, arc-shaped convex surface; 54, arc locking convex surface; 55, restriction reinforcing rib; 56, flat lower recess; 57, transversal inner-convex locking portion; 58, longitudinal locking groove body; 581, inner inclined locking surface; 582, locking arc concave surface; 583, outer inclined locking surface; 584, outer arc guiding convex surface; 585, upper groove opening; 59, lower surface.

DETAILED DESCRIPTION OF EMBODIMENTS

The following are specific embodiments of the invention combined with the accompanying drawings to further describe the technical solutions of the invention, but the invention is not limited to these embodiments.

First Embodiment

Figure 2:
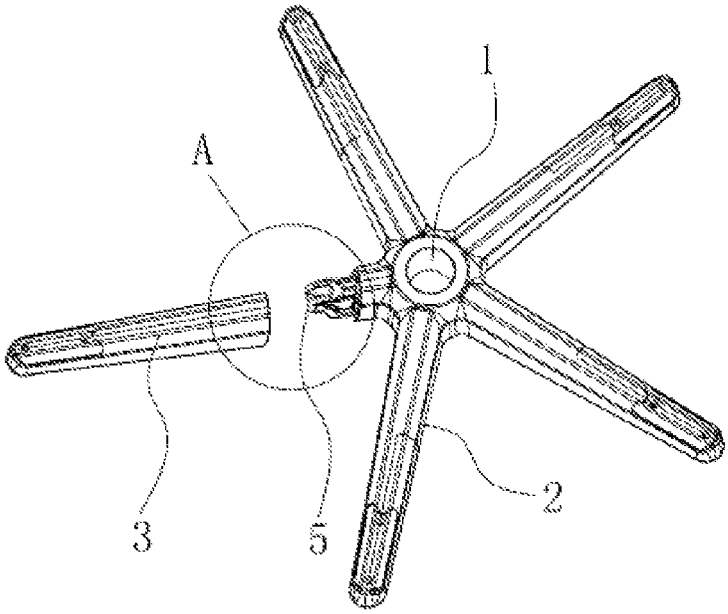
FIG. 2 is a schematic partial exploded structure view of a chair foot assembly in a top side state according to the embodiment of the invention.
Figure 4:
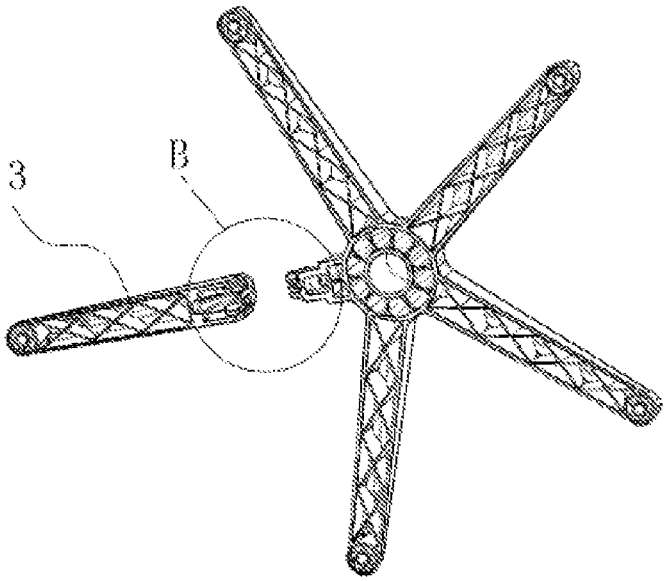
FIG. 4 is a schematic partial exploded structure view of a chair foot assembly in a bottom side state according to another embodiment of the invention.

As shown in FIGS. 1-2 and FIG. 4, a chair foot assembly of the embodiment of the invention may include a number of one-piece structure chair feet 2 connected to a central chassis (also referred to as central body) 1 as a whole, the number of one-piece structure chair feet 2 is 4 and the central chassis 1 and the one-piece structure chair feet 2 are integrally formed by injection molding. The injection molding makes the one-piece structure chair feet 2 have high structural strength and reduces the difficulty of mold opening. At least one detachable chair foot 3 is further connected to the outer circumference of the central chassis 1 through a connecting mechanism(s). The detachable chair foot 3 is located between two adjacent one-piece structure chair feet 2, and the included angle between the adjacent two one-piece structure chair feet 2 is divided into two equal angles of separation by the detachable chair foot 3, and the remaining two adjacent one-piece structure chair feet 2 form a uniform angle with equal angles. The angles of separation are equal to the uniform angle.

A combination form of a part of one-piece structure chair foot and a part of the detachable chair foot is adopted, which can simplify production and processing procedures, and improve production and processing efficiency. At the same time, it can also meet size requirements of the box to the greatest extent and reduce the amount of assembly work of subsequent purchasers. The design of the chair foot assembly is more humane.

In a specific implementation, the total number of the one-piece structure chair feet 2 plus the total number of the detachable chair foot 3 is 4-6. For example, in this embodiment, there are 5 in total.

Figure 3:
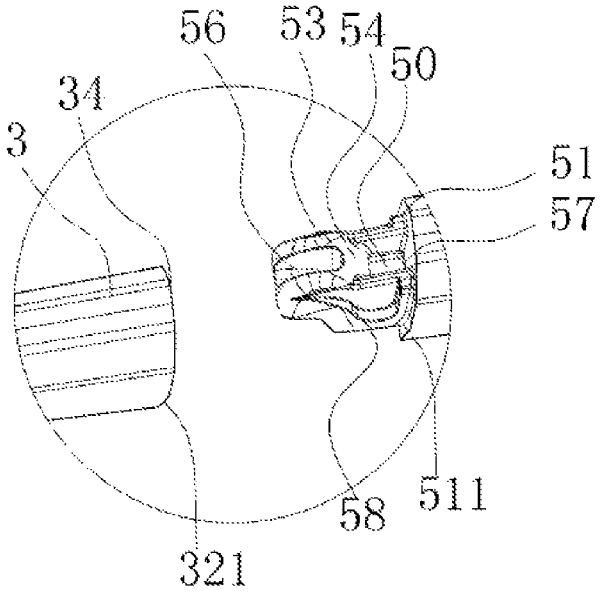
FIG. 3 is a schematic enlargement structure view of A in FIG. 2.
Figure 5:
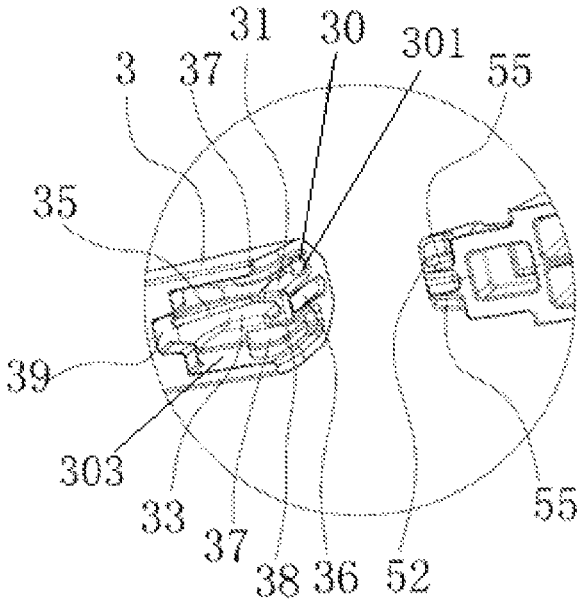
FIG. 5 is a schematic enlargement structure view of B in FIG. 4.

Specifically, as shown in FIG. 3 and FIG. 5, the above-mentioned connecting mechanism of the detachable chair foot is connected between the central chassis 1 and a detachable chair foot 3. The connecting mechanism of a detachable chair foot may include: a one-foot connecting arm 5 and a connecting groove 30. The one-foot connecting arm 5 is connected to the central chassis 1 and extends radially outward. The connecting groove 30 is disposed on a lower side of an inner end of the detachable chair foot 3. The connecting groove 30 is provided with a transversal groove opening 301 located at an end portion of the inner end of the detachable chair foot 3 and a longitudinal groove opening 303 located on the lower side of the inner end of the detachable chair foot 3. The one-foot connecting arm 5 is matched with the connecting groove 30.

The connecting groove 30 is located at the lower side of an inner end of the detachable chair foot 3, which can improve the aesthetics. The match of the one-foot connecting arm 5 and the connecting groove 30 can protect the one-foot connecting arm 5 and prevent the exposure of the one-foot connecting arm 5 from affecting the service life.

As shown in FIG. 3, the joint between the one-foot connecting arm 5 and the central chassis 1 has a first inclined matching surface 51, and the inclination direction of the first inclined matching surface 51 is a direction inclining outward from top to bottom. An end surface of an inner end surface of the detachable chair foot 3 is a second inclined matching surface 34 that matches with the first inclined matching surface 51. Further, an arc locking concave surface 511 is disposed on a lower side of the first inclined matching surface 51, and a lower side of the second inclined matching surface 34 is provided with an arc locking convex surface 321 matched with the arc locking concave surface 511.

The match of the first inclined matching surface 51 and the second inclined matching surface 34 can improve the load-bearing performance. At the same time, the arc locking concave surface 511 and the arc locking convex surface 321 are also designed to facilitate the arc locking convex surface 321 to enter the first inclined matching surface 51, and thereby the assembly efficiency can be improved. And the arc locking concave surface 511 cooperating with the arc locking convex surface 321 further can improve the load-bearing performance.

The first inclined matching surface 51 is an inverted U-shaped inclined surface. Similarly, the second inclined matching surface 34 is also an inverted U-shaped inclined surface.

As shown in FIGS. 3 and 5, two longitudinal locking groove bodies 58 are symmetrically and respectively disposed on two longitudinal side surfaces of the one-foot connecting arm 5, and correspondingly, two inner-convex locking portions 37 are respectively disposed on two opposite side groove walls of the connecting groove 30. The two inner-convex locking portions 37 operatively enter into the two longitudinal locking groove bodies 58 from upper groove openings of the two longitudinal locking groove bodies 58, and are snapped into the two longitudinal locking groove bodies 58.

The design of two symmetrically arranged longitudinal locking groove bodies 58 in cooperation with the matched two symmetrically distributed inner-convex locking portions 37 can ensure the uniformity of the force and facilitate the development and processing design. At the same time, it is also convenient for the connecting groove 30 of the detachable chair foot 3 to be inserted into the one-foot connecting arm 5 and rotated upward so that the connecting groove 30 and the one-foot connecting arm 5 are assembled in place, that is, the two inner-convex locking portions 37 respectively enter into the two longitudinal locking groove bodies 58 from the top sides of the two longitudinal locking groove bodies 58, and are snapped into groove bottoms of the longitudinal locking groove bodies body 58. This structure can restrict the two in the width direction and fix the two in the axial direction. With the cooperation of the matched the first inclined matching surface and the second inclined matching surface, the two longitudinal locking groove bodies 58 and the two inner-convex locking portions 37 can make the structural strength of the joint to be greatly improved, especially the axial locking strength and the vertical load-bearing capacity.

Figure 3A:
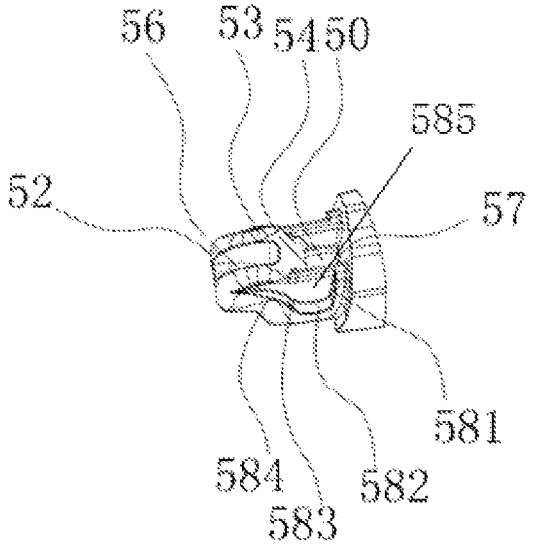
FIG. 3*a* is a schematic structure view of a one-foot connecting arm in FIG. 3.

As shown in FIG. 3*a*, each of the two longitudinal locking groove bodies 58 may include an inner inclined locking surface 581, a locking arc concave surface 582 connected to a lower side of the inner inclined locking surface 581, an outer inclined locking surface 583 tangent to the locking arc concave surface 582, and an outer arc guiding convex surface 584 tangent to the outer inclined locking surface 583. An acute angle is formed between the inner inclined locking surface and the outer inclined locking surface. Each of the two inner-convex locking portions 37 is rotatable along the outer arc guiding convex surface 584 and limited between the inner inclined locking surface 581 and the outer inclined locking surface 583.

The outer arc guiding convex surface 584 plays a guiding role, and the design of the outer arc guiding convex surface 584 can facilitate the two inner-convex locking portions 37 to enter the outer inclined locking surface 583 of the two longitudinal locking groove bodies 58 along the outer arc guiding convex surface 584, which further improves the efficiency of disassembly and assembly.

Figure 5A:
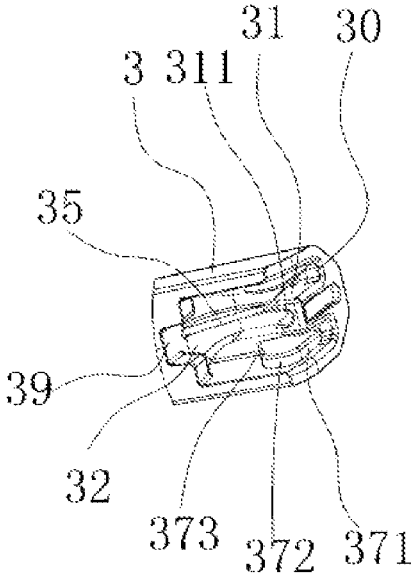
FIG. 5*a* is a schematic structural view of the connecting groove in FIG. 4.

As shown in FIG. 5*a*, each of the two inner-convex locking portions 37 may include a first matching inclined surface 371 matched with the inner inclined locking surface 581, a locking arc convex surface 372 matched with the locking arc concave surface 582, and a second matching inclined surface 373 matched with the outer inclined locking surface 583. When the each of the two inner-convex locking portions 37 is in a locked state, the first matching inclined surface 371 is matched with the inner inclined locking surface 581, the locking arc convex surface 372 is matched with the locking arc concave surface 582, and the second matching inclined surface 373 is matched with the outer inclined locking surface 583.

The above-mentioned structure can further expand the contact surface. At the same time, by using the first matching inclined surface 371 and the second matching inclined surface 373 with a certain included angle, it can make the each of the inner-convex locking portions 37 have a better self-locking performance once the each of the inner-convex locking portions 37 enters into one of the longitudinal locking groove bodies 58.

Secondly, the design of the inner-convex locking portions 37 can strengthen the structure of one end of the detachable chair foot 3 provided with the connecting groove 30 to prolong the service life.

As shown in FIGS. 3 and 5, a concave-convex matching structure is disposed between the one-foot connecting arm 5 and the connecting groove 30 and is configured for fixing the one-foot connecting arm 5 into the connecting groove 30. The concave-convex matching structure can further improve the connection strength between the one-foot connecting arm 5 and the connecting groove 30, and can facilitate the disassembly and assembly of the detachable chair foot 3. The concave-convex matching structure may include a concave disposed on an inner groove wall of the connecting groove 30 away from the transversal groove opening, and a convex correspondingly disposed at an end of the one-foot connecting arm 5 away from the central chassis 1. In this embodiment, a concave provided on the inner groove wall of the connecting groove 30 away from the transversal groove opening and a corresponding convex provided at one end of the one-foot connecting arm 5 away from the central chassis 1 are taken as an example for detailed description.

Specifically, as shown in FIGS. 3*a* and 5*a*, the concave-convex matching structure may include a concave disposed on the inner groove wall of the connecting groove 30 away from the transversal groove opening, and a convex 52 correspondingly disposed on one end of the one-foot connecting arm 5 away from the central chassis 1. The above-mentioned concave and the convex 52 are engaged with each other. The concave is the transversal groove 32 to facilitate the entrance of the convex 52.

When assembling, the convex 52 is inserted into the transversal groove 32 partly or a little, and then the two inner-convex locking portions 37 and the longitudinal locking groove bodies 58 are respectively fitted or matched with each other.

The position of the transversal groove 32 and the coordinated convex 52 can further improve the load-bearing capacity of the joint. At the same time, this design can further improve the self-locking performance and prevent free separation of the two.

The transversal groove 32 can be a square groove, and the convex 52 can be a square convex, and the two are matched with each other; or the transversal groove 32 is a groove with a ¼ top side arc, and the convex 52 is a convex with a ¼ top side arc, and the two match with each other.

In a specific implementation, a longitudinal communicating groove 39 may also be disposed in the transversal groove 32. As shown in FIGS. 5 and 5*a*, an upper end of the longitudinal communicating groove 39 communicates with the transversal groove 32 disposed on the inner groove wall of the connecting groove 30. A lower end of the longitudinal communicating groove 39 communicates outside.

Figure 5B:
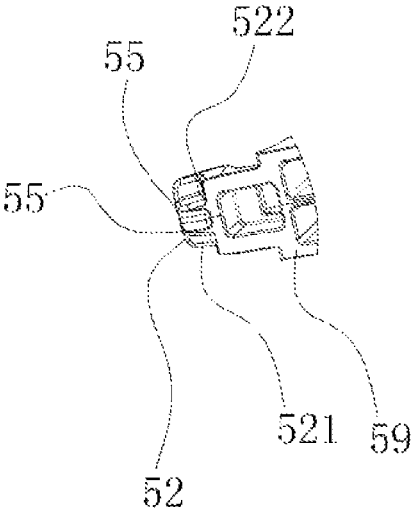
FIG. 5*b* is a schematic structure bottom view of the one-foot connecting arm in FIG. 4.

As shown in FIG. 5*b*, a lower surface of the convex 52 connected to the end of the one-foot connecting arm 5 away from the central chassis 1 is located at a top side of a lower surface 59 of the one-foot connecting arm 5, and the lower surface 59 of the one-foot connecting arm 5 is connected to the lower surface 521 of the convex 52 by a connecting surface 522. Two restriction reinforcing ribs 55 are connected between the lower surface of the connecting surface 522 and the lower surface of the convex 52, and the two restriction reinforcing ribs 55 are both snapped into the above-mentioned longitudinal communicating groove 39.

The lower surface 521 of the convex 52 is mounted on the lower transversal groove wall of the transversal groove 32 to improve the structural strength of the joint.

The longitudinal communicating groove 39 has multiple functions: firstly, it can be used to reduce weight and reduce the amount of material input; secondly, it can cooperate with the restriction reinforcing rib 55 to further improve the structural stability of the joint.

Preferably, as shown in FIG. 3*a*, an arc-shaped convex surface 53 is disposed on the upper surface of an outer end of the one-foot connecting arm 5, especially on the upper surface of the convex 52 in this embodiment. As shown in FIG. 5, a groove bottom of the connecting groove 30 is correspondingly provided with an arc-shaped concave surface 33 engaged with the arc-shaped convex surface 53. The above structure can improve the efficiency of disassembly and assembly, and the stability of the contact connection. At the same time, the above structure can play a role of mutual guidance and prevent serious wear.

Furthermore, as shown in FIG. 3*a*, the arc-shaped convex surface 53 is provided with a flat lower recess (also referred to as flat depression) 56. As shown in FIG. 5, the arc-shaped concave surface 33 is provided with a flat reinforcing rib 35; the flat reinforcing rib 35 is embedded in the flat lower recess 56 for further position limiting within.

The flat reinforcing rib 35 can realize a structural reinforcement on one end of the detachable chair foot 3 where the connecting groove 30 is disposed on, and as well as can also play a role of position limiting.

As shown in FIGS. 2-3, FIG. 7 and FIG. 9, an assembling method of the embodiment is as follows:

S1, fitting the end of the detachable chair foot 3 disposed with the connecting groove 30 onto the one-foot connecting arm 5 along a direction with an included angle less than 90° relative to a central axis of the central chassis;

S2, extending the convex 52 on the one-foot connecting arm 5 into the transversal groove 32 of the inner groove wall of the connecting groove 30, and thereby making the first inclined matching surface 51 and the second inclined matching surface 52 form an acute angle b; and S3, taking the convex 52 and the transversal groove 32 as a turning fulcrum, and rotating the detachable chair foot 3 along a counterclockwise direction under the action of an external force, and thereby the two inner-convex locking portions 37 entering into the two longitudinal locking groove bodies 58 respectively from upper groove openings of the two longitudinal locking groove bodies 58 and then being snapped with each other, the convex extending into the concave in place, and the first inclined matching surface 51 engaging with the second inclined matching surface 34.

Second Embodiment

The other structure of the second embodiment is the same as that of the first embodiment, and the main difference is: the concave-convex matching structure of the chair foot assembly disassembly structure in the second embodiment is different from that of the first embodiment, as shown in FIG. 5. Specifically, the concave-convex matching structure may include a longitudinal groove 50 disposed on the one-foot connecting arm 5 near the central chassis 1, and a longitudinal protrusion 31 is correspondingly disposed on a groove bottom of the connecting groove 30. A top portion of the longitudinal groove 50 communicates outside, and the longitudinal protrusion 31 extends into the longitudinal groove 50. Of course, the concave-convex matching structure shown can also be arranged in reverse, that is, the concave-convex matching structure may include a longitudinal protrusion 31 disposed on the one-foot connecting arm 5 near the central chassis 1, and a longitudinal groove correspondingly disposed at the bottom of the connecting groove 30. This structure will not be repeated here.

Specifically, as shown in FIGS. 2 and 5*b*, a side surface of the longitudinal protrusion away from the transversal groove opening is an inclined locking surface 311, and a groove wall of the longitudinal groove 50 facing the inclined locking surface 311 is provided with an arc locking convex surface 54; the inclined locking surface 311 is tangent to the arc locking convex surface 54, when the longitudinal protrusion 31 extends into the longitudinal groove 50 in place.

a groove wall of the longitudinal groove 50 opposite to the arc locking convex surface 54 is provided with a transversal inner-convex locking portion 57; a side surface of the longitudinal protrusion 31 away from the inclined locking surface 311 is provided with a locking groove 36 for the transversal inner-convex locking portion 57 to be snapped into, and the transversal inner-convex locking portion 57 is snapped into the locking groove 36 for increasing a vertical bearing capacity. A depth of the locking groove 36 gradually increases from bottom to top, a lower end of the locking groove 36 communicates outside; and the transversal inner-convex locking portion 57 enters the locking groove 36 through the lower end of the locking groove 36. The side surface of the longitudinal protrusion 31 where the locking groove 36 is disposed on is flush with an end surface of the inner end of the detachable chair foot 3, and an upper end of the locking groove extends to a top side of the end surface of the inner end of the detachable chair foot 3.

As shown in FIG. 5, the groove bottom of the connecting groove 30 can further be provided with a transversal reinforcing rib 38 connected between the longitudinal protrusion 31 and the two inner-convex locking portions 37 to improve the structural strength. At the same time, the transversal reinforcing rib 38 and the flat reinforcing rib 35 are distributed in a T shape.

In some specific implementations, in addition to the concave-convex matching structure in this embodiment, the concave-convex matching structure in the first embodiment can further be provided at the same time.

Third Embodiment

The structure and principle of this embodiment are basically the same as those of the first embodiment, so they will not be repeated here. The difference is that the chair foot assembly in this embodiment may include at least one one-piece structure chair foot 2 integrally connected with the central chassis 1, and several detachable chair feet 3. An inner end of each of the several detachable chair feet 3 is connected to the central chassis 1 through a detachable connecting mechanism. The included angle between the adjacent two detachable chair feet 3 is divided into two equal angles of separation by the one-piece structure chair foot 2, and the remaining two adjacent detachable chair feet 3 form a uniform angle with equal angles. The angles of separation are equal to the uniform angle.

Fourth Embodiment

The structure and principle of this embodiment are basically the same as those of the first embodiment, and they will not be repeated here. The difference is that the number of detachable chair feet 3 is two, and the number of one-piece structure chair feet 2 is three.

Fifth Embodiment

Figure 6:
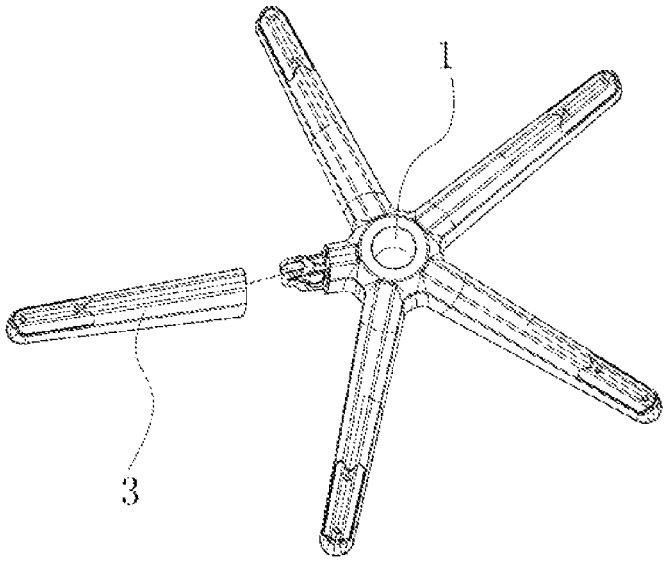
FIG. 6 is a perspective schematic structure view of a chair foot assembly according to another embodiment of the invention.
Figure 7:
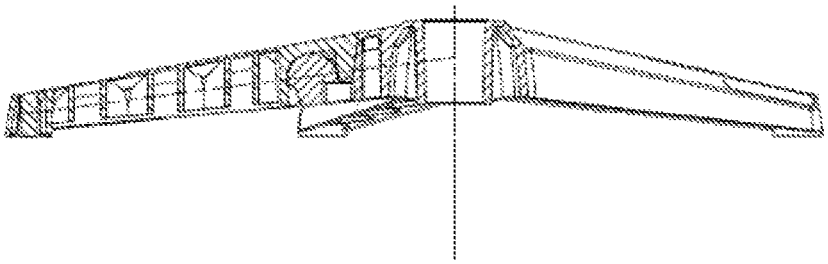
FIG. 7 is a schematic cross-sectional view of a connecting mechanism of a detachable chair foot according to another embodiment of the invention.
Figure 8:
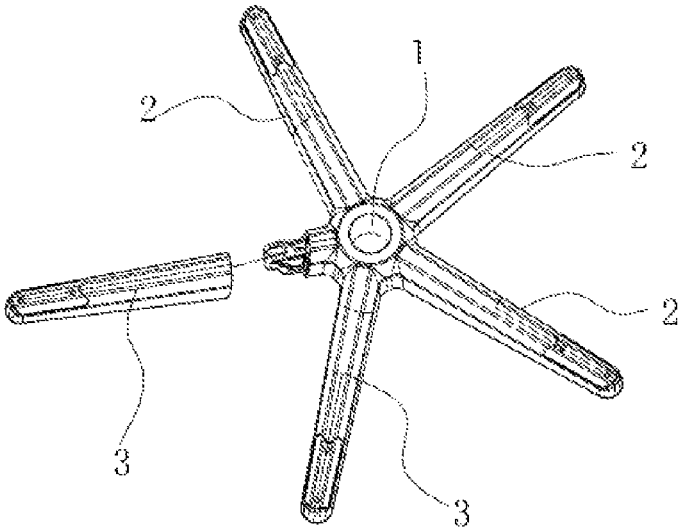
FIG. 8 is a perspective schematic structural view of a chair foot assembly according to an embodiment of the invention.
Figure 9:
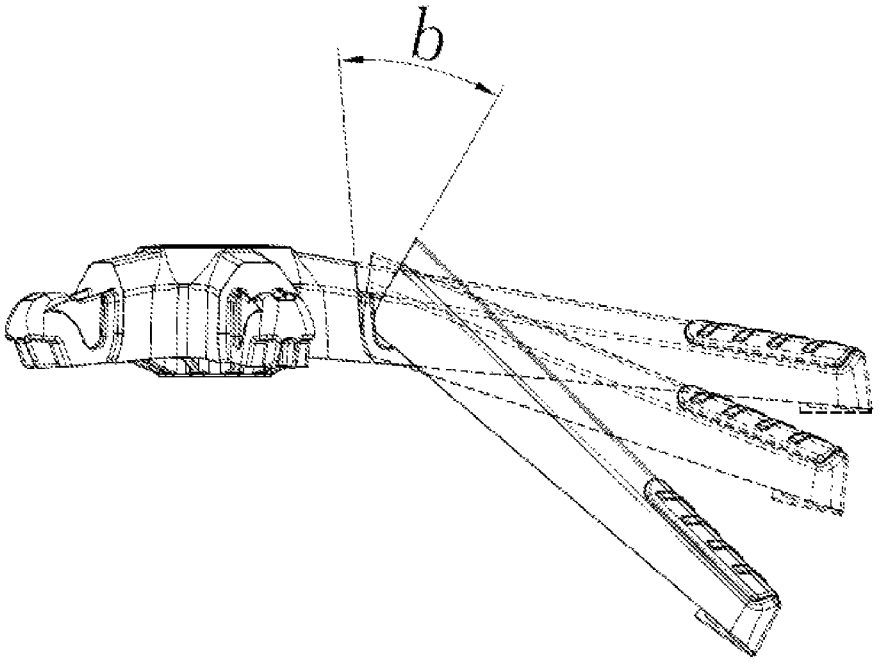
FIG. 9 is a schematic flowchart of an assembly method of a detachable chair foot of according to an embodiment of the invention.

The structure and principle of this embodiment are basically the same as those of the first embodiment, so they won't repeat here. The difference is that the chair feet disposed on the outer circumference of the central disc 1 are all detachable chair feet 3, and the number of the detachable chair feet 3 is five. As shown in FIG. 6, each of all chair feet is of a detachable structure.

Sixth Embodiment

A swivel chair is provided in this embodiment with any of the chair foot assembly of the first embodiment to fifth embodiment.

Seventh Embodiment

The structure and principle of this embodiment are basically the same as the first embodiment. The difference is that the concave-convex matching structure may include a convex disposed on an inner groove wall of the connecting groove 30 away from the transversal groove, and a groove correspondingly disposed at one end of the one-foot connecting arm 5 away from the central chassis 1, which is opposite to the specific concave-convex matching structure in the first embodiment.

The specific embodiments described herein are merely examples to illustrate the spirit of the invention. Those skilled in the art to which the invention belongs can make various modifications or supplements or other similar alternatives to the specific embodiments described, but they will not deviate from the spirit of the invention or exceed the range defined in the invention.

What is claimed is:

1. A connecting mechanism of a detachable chair foot, connected between a central chassis and the detachable chair foot, comprising:

a one-foot connecting arm, connected to the central chassis and extending radially outward;

a connecting groove, disposed on a lower side of an inner end of the detachable chair foot, wherein the connecting groove is provided with a transversal groove opening at an end portion of the inner end of the detachable chair foot and a longitudinal groove opening on the lower side of the inner end of the detachable chair foot, and the one-foot connecting arm is operatively engaged with the connecting groove;

two inner-convex locking portions, respectively disposed on two opposite side groove walls of the connecting groove;

two longitudinal locking groove bodies, disposed on the one-foot connecting arm, wherein the two inner-convex locking portions operatively enter into the two longitudinal locking groove bodies respectively from upper groove openings of the two longitudinal locking groove bodies and are snapped into the two longitudinal locking groove bodies; and a concave-convex matching structure, configured for fixing the one-foot connecting arm into the connecting groove.

2. The connecting mechanism of a detachable chair foot as claimed in claim 1, wherein the concave-convex matching structure comprises a concave disposed on an inner groove wall of the connecting groove away from the transversal groove opening, and a convex correspondingly disposed at an end of the one-foot connecting arm away from the central chassis; or the concave-convex matching structure comprises a convex disposed on an inner groove wall of the connecting groove away from the transversal groove opening, and a concave correspondingly disposed at an end of the one-foot connecting arm away from the central chassis;

wherein the concave is operatively engaged with the convex in a concave-convex fit.

3. The connecting mechanism of a detachable chair foot as claimed in claim 2, wherein an upper surface of an outer end of the one-foot connecting arm is provided with an arc-shaped convex surface, and a groove bottom of the connecting groove is correspondingly provided with an arc-shaped concave surface fitted with the arc-shaped convex surface.

4. The connecting mechanism of a detachable chair foot as claimed in claim 3, wherein the arc-shaped convex surface is provided with a flat lower recess, the arc-shaped concave surface is provided with a flat reinforcement rib, and the flat reinforcement rib is embedded in the flat lower recess for position limiting.

5. The connecting mechanism of a detachable chair foot as claimed in claim 2, wherein an inner groove wall of the connecting groove is further provided with a longitudinal communicating groove, and an upper end of the longitudinal communicating groove is connected with the concave disposed on the inner groove wall of the connecting groove.

6. The connecting mechanism of a detachable chair foot as claimed in claim 5, wherein a lower surface of the convex connected to the end of the one-foot connecting arm away from the central chassis is located at a top side of a lower surface of the one-foot connecting arm, and the lower surface of the one-foot connecting arm is connected to the lower surface of the convex by a connecting surface.

7. The connecting mechanism of a detachable chair foot as claimed in claim 6, wherein restriction reinforcement ribs are connected between the connecting surface and the lower surface of the convex, and the restriction reinforcement ribs are snapped in the longitudinal communicating groove.

8. The connecting mechanism of a detachable chair foot as claimed in claim 2, wherein a location where the one-foot connecting arm is connected to the central chassis is provided with a first inclined matching surface, and an inclination direction of the first inclined matching surface is a direction inclining outward from top to bottom; an end surface of the inner end of the detachable chair foot is a second inclined matching surface matched with the first inclined matching surface.

9. The connecting mechanism of a detachable chair foot as claimed in claim 8, wherein a lower side of the first inclined matching surface is provided with an arc locking concave surface, and a lower side of the second inclined matching surface is provided with an arc locking convex surface matched with the arc locking concave surface.

10. The connecting mechanism of a detachable chair foot as claimed in claim 1, wherein the concave-convex matching structure comprises a longitudinal groove disposed on the one-foot connecting arm near the central chassis, and a longitudinal protrusion correspondingly disposed on a groove bottom of the connecting groove; and a top portion of the longitudinal groove communicates with outside;

wherein the longitudinal protrusion extends into the longitudinal groove.

11. The connecting mechanism of a detachable chair foot as claimed in claim 10, wherein a side surface of the longitudinal protrusion away from the transversal groove opening is an inclined locking surface, and a groove wall of the longitudinal groove facing the inclined locking surface is provided with an arc locking convex surface; the inclined locking surface is tangent to the arc locking convex surface, when the longitudinal protrusion extends into the longitudinal groove in place.

12. The connecting mechanism of a detachable chair foot as claimed in claim 11, wherein a groove wall of the longitudinal groove opposite to the arc locking convex surface is provided with a transversal inner-convex locking portion; a side surface of the longitudinal protrusion away from the inclined locking surface is provided with a locking groove for the transversal inner-convex locking portion to be stuck into, and the transversal inner-convex locking portion is snapped into the locking groove for increasing a vertical bearing capacity.

13. The connecting mechanism of a detachable chair foot as claimed in claim 12, wherein a depth of the locking groove gradually increases from bottom to top, a lower end of the locking groove communicates with outside; and the transversal inner-convex locking portion enters the locking groove through the lower end of the locking groove.

14. The connecting mechanism of a detachable chair foot as claimed in claim 13, wherein the side surface of the longitudinal protrusion where the locking groove is disposed on is flush with an end surface of the inner end of the detachable chair foot, and an upper end of the locking groove extends to a top side of the end surface of the inner end of the detachable chair foot.

15. The connecting mechanism of a detachable chair foot as claimed in claim 1, wherein the two longitudinal locking groove bodies are symmetrically distributed and respectively arranged on two longitudinal sides of the one-foot connecting arm, and the two inner-convex locking portions are symmetrically distributed and respectively engaged with the two longitudinal locking groove bodies.

16. The connecting mechanism of a detachable chair foot as claimed in claim 15, wherein each of the two longitudinal locking groove bodies comprises an inner inclined locking surface, a locking arc concave surface connected to a lower side of the inner inclined locking surface, an outer inclined locking surface tangent to the locking arc concave surface, and an outer arc guiding convex surface tangent to the outer inclined locking surface; an acute angle is formed between the inner inclined locking surface and the outer inclined locking surface, each of the two inner-convex locking portions is rotatable along the outer arc guiding convex surface and limited between the inner inclined locking surface and the outer inclined locking surface.

17. The connecting mechanism of a detachable chair foot as claimed in claim 16, wherein each of the two inner-convex locking portions comprises a first matching inclined surface matched with the inner inclined locking surface, a locking arc convex surface matched with the locking arc concave surface, and a second matching inclined surface matched with the outer inclined locking surface; the first matching inclined surface is matched with the inner inclined locking surface, the locking arc convex surface is matched with the locking arc concave surface, and the second matching inclined surface is matched with the outer inclined locking surface, when the each of the two inner-convex locking portions is in a locked state.

18. A chair foot assembly comprising a central chassis, wherein the chair foot assembly further comprises at least one detachable chair foot, and the central chassis is connected to the at least one detachable chair foot by the connecting mechanism of the detachable chair foot as claimed in claim 1.

19. A assembling method of a chair foot assembly using a connecting mechanism of a detachable chair foot;

wherein the connecting mechanism comprises:

a one-foot connecting arm, connected to the central chassis and extending radially outward;

a connecting groove, disposed on a lower side of an inner end of the detachable chair foot, wherein the connecting groove is provided with a transversal groove opening at an end portion of the inner end of the detachable chair foot and a longitudinal groove opening on the lower side of the inner end of the detachable chair foot, and the one-foot connecting arm is operatively engaged with the connecting groove;

two inner-convex locking portions, respectively disposed on two opposite side groove walls of the connecting groove;

two longitudinal locking groove bodies, disposed on the one-foot connecting arm, wherein the two inner-convex locking portions operatively enter into the two longitudinal locking groove bodies respectively from upper groove openings of the two longitudinal locking groove bodies and are snapped into the two longitudinal locking groove bodies; and a concave-convex matching structure, configured for fixing the one-foot connecting arm into the connecting groove;

wherein the concave-convex matching structure comprises a concave disposed on an inner groove wall of the connecting groove away from the transversal groove opening, and a convex correspondingly disposed at an end of the one-foot connecting arm away from the central chassis;

wherein a location where the one-foot connecting arm is connected to the central chassis is provided with a first inclined matching surface, and an inclination direction of the first inclined matching surface is a direction inclining outward from top to bottom; an end surface of the inner end of the detachable chair foot is a second inclined matching surface matched with the first inclined matching surface;

wherein the assembling method comprises:

S1, fitting the inner end of the detachable chair foot disposed with the connecting groove onto the one-foot connecting arm along a direction with an included angle less than 90° relative to a central axis of the central chassis;

S2, extending the convex on the one-foot connecting arm into the concave of the inner groove wall of the connecting groove, and making the first inclined matching surface and the second inclined matching surface form an acute angle; and S3, taking the convex and the concave as a turning fulcrum and rotating the detachable chair foot along a counterclockwise direction under the action of an external force, and thereby the two inner-convex locking portions entering into the two longitudinal locking groove bodies respectively from upper groove openings of the two longitudinal locking groove bodies and then being snapped with each other, the convex extending into the concave in place, and the first inclined matching surface engaging with the second inclined matching surface.

* * * * *